United States Patent [19]

Weaver

[11] 3,983,258

[45] Sept. 28, 1976

[54] PROCESS OF PACKAGING EDIBLE PRODUCTS CONTAINING EXPOSED BONES

[75] Inventor: Norman D. Weaver, Bartlett, Ill.

[73] Assignee: Continental Can Company, Inc., New York, N.Y.

[22] Filed: Feb. 7, 1975

[21] Appl. No.: 548,030

[52] U.S. Cl. ..... 426/307; 53/22 B; 53/30 S; 156/85; 206/497; 206/521; 426/125; 426/129; 426/389; 426/412

[51] Int. Cl.[2] ..... B65B 25/00; B65B 31/02; B65B 53/04; B65B 53/06

[58] Field of Search ..... 426/129, 125, 124, 92, 426/106, 412, 132, 393, 410, 414, 415, 305, 307, 310, 420; 206/497, 521, 363; 53/22 B, 30 S; 427/154–156, 207, 256; 156/85

[56] References Cited

UNITED STATES PATENTS

| | | | |
|---|---|---|---|
| 2,682,475 | 6/1954 | Smith | 426/307 X |
| 2,733,151 | 1/1956 | Zuercher | 426/307 |
| 2,891,870 | 6/1959 | Selby et al. | 426/124 |
| 2,955,043 | 10/1960 | Rosenthal | 426/307 X |
| 3,113,874 | 12/1963 | Baush et al. | 53/30 S |
| 3,653,927 | 4/1972 | Howell et al. | 426/124 |

OTHER PUBLICATIONS

Modern Packaging, 11/55, pp. 116–119, 220, 222.

*Primary Examiner*—Steven L. Weinstein
*Attorney, Agent, or Firm*—Diller, Brown, Ramik & Wight

[57] ABSTRACT

The disclosure relates to a process of packaging an edible product having an exposed bone by applying hot melt material to the exposed bone, encasing the product in a package, and closing the package which preferably is a bag which is heat shrunk and due to the heat shrinking operation or by the application of heat in the absence of heat shrinking the hot melt material is adhered to the bag with a bond strength greater than that between the hot melt material and the bone such that upon the removal of the bag the hot melt is removed from the bone to permit subsequent processing of the product.

5 Claims, 4 Drawing Figures

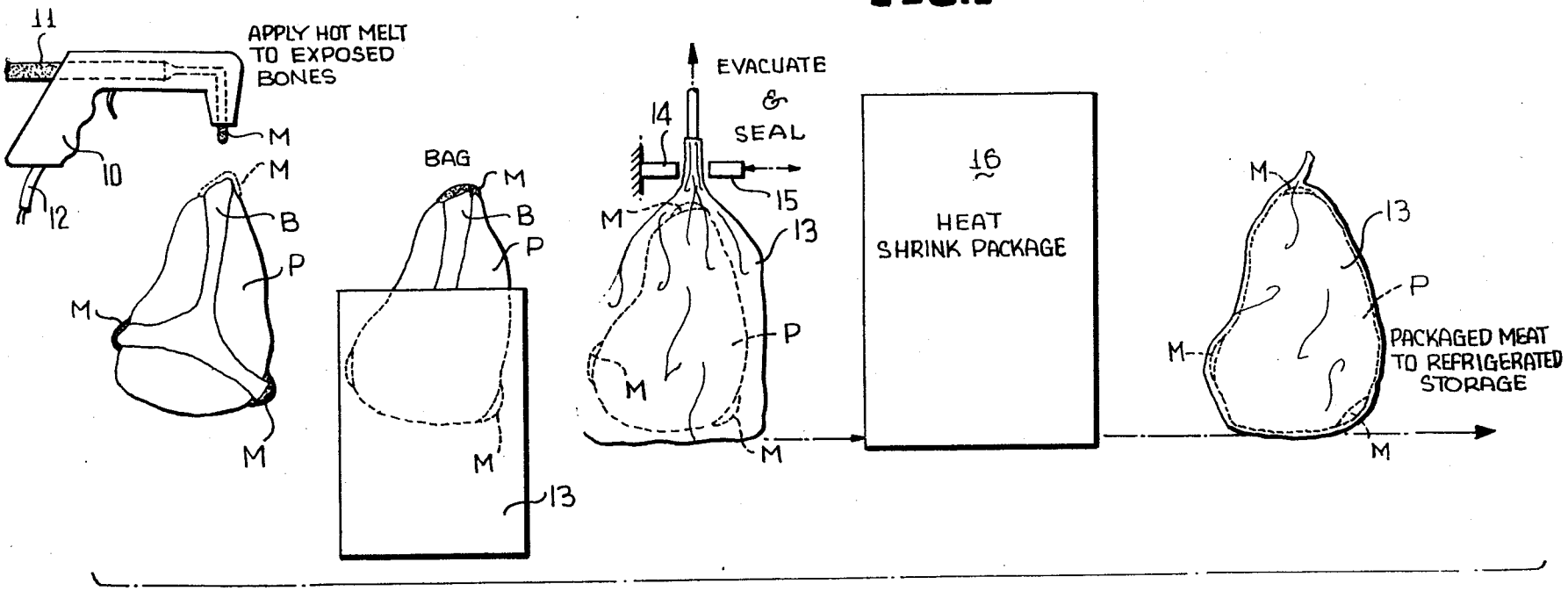
FIG.1
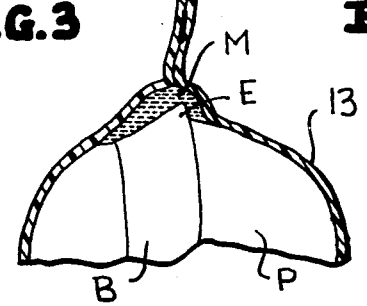
FIG.2
FIG.3
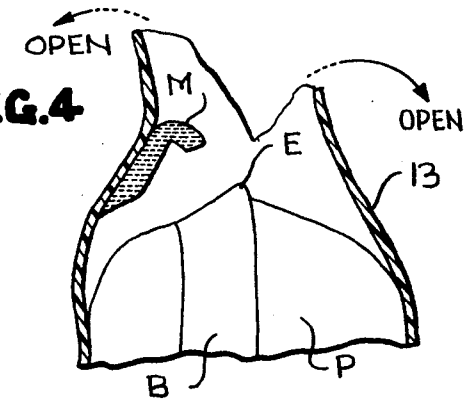
FIG.4

PROCESS OF PACKAGING EDIBLE PRODUCTS CONTAINING EXPOSED BONES

The present invention is directed to a process of packaging an edible product having exposed bone to preclude the rupture of the package which might otherwise occur if the bone remained exposed.

It is known to provide rough textured paper stock impregnated with a food-grade wax to cover the bone of meat, such as beef ribs. The paper stock covers the exposed bone and when placed in a bag the latter is precluded from being torn during storage or shipment because of the protection afforded the bag from the raw and generally sharp bone by the paper stock.

In keeping with the present invention savings of both labor and raw material costs at the packing plant are achieved by providing a novel process which eliminates the use of paper stock material and instead achieves the desired protection by applying hot melt material directly to the exposed bone of meat or other products intended for human consumption, encasing the product in a bag, and closing the same.

Preferably though not necessarily the bag is evacuated, heat sealed and shrunk to conform to the packaged product.

In further keeping with this invention the hot melt material is adhered to the bag with a bond strength greater than that between the hot melt material and the exposed bone whereby upon the removal of the bag the hot melt material is automatically removed and the product can then be used as desired.

With the above and other objects in view that will hereinafter appear, the nature of the invention will be more clearly understood by reference to the following detailed description, the appended claimed subject matter, and the several views illustrated in the accompanying drawings.

IN THE DRAWING:

FIG. 1 is a schematic view illustrating the progressive steps of the present packaging process, and illustrates the steps of applying hot melt material to exposed bones of an edible product, packaging the product in a bag, evacuating and heat sealing the bag, and thereafter heat shrinking the bag to form the final product or package.

FIG. 2 is a fragmentary view, and illustrates the manner in which the hot melt material covers a jagged exposed bone of the product.

FIG. 3 is a view similar to FIG. 2, and illustrates the maner in which the hot melt material protects the bag from being ruptured by the jagged though covered exposed bone.

FIG. 4 is a fragmentary view similar to FIG. 3, and illustrates the manner in which upon the opening of the bag the hot melt material is removed from the bone due to its being bonded to the bag with greater bond strength than to the exposed bone and adjoining portions of the product.

Fresh primal or subprimal cuts of fresh beef, pork or veal have exposed bone surfaces that have sharp or jagged edges. A typical edible product P (FIG. 2) might include a bone B having an exposed raw and jagged edge E which would normally puncture a bag or similar package if not covered. However, in keeping with this invention hot melt material M is applied to the bone B, and particularly the jagged edge E thereof, by a conventional hot melt applicator in the form of a hand gun 10 which is supplied hot melt material M through a conduit 11 from a suitable source. The hand gun 10 is heated by an internal coil (not shown) which is in turn connected by wires 12 to a suitable source (not shown) of electrical energy. The entire bone B or selected portions thereof are covered by the hot melt material as might be found necessary or desirable, depending upon the amount of bone exposure and particularly the amount of exposed raw edges E.

After one or more edges E or portions of the bone B or the entire bone B are covered with the hot melt material the product P is inserted into a plastic package or bag 13 (FIG. 1) which is then evacuated in a conventional manner and heat sealed closed by conventional heat sealing bars 14, 15. The product P is now enclosed within the bag 13 is placed in a heat shrink tunnel 16 or any conventional construction such that the bag 13 shrinks to the general outline of the product P in the manner indicated in the right-hand most view of FIG. 1. The material from which the bag 13 is constructed and the material M applied to the bone B is selected such that the bond strength between the hot melt material M and the bag 13 is greater than that of the bond strength between the hot material M and the bone B, as well as portions of the product p which may be covered by the hot melt adhesive. Due to this bond strength, upon the opening of the bag in the manner illustrated in FIG. 4 the hot melt adhesive is automatically released from the product P and remains adhered to the bag 13 to permit ready use of the product P. Due to the bond strengths just noted the separate removal of the bag 13 is from the product P followed by the separate removal of the hot melt material M is unnecessary since both the bag and the hot melt material adhered thereto are removed simultaneously.

The particular type of thermal plastic or like hot melt material M that can be applied to the product P can vary but the most acceptable from the standpoint of cost, availability and approval for contact with food products, especially meat, are waxes and specifically microcrystalline waxes. These waxes are available commercially with varying melting points, softness, and elasticity, color and many grades are approved for use in direct contact with food products. The precise choice of the material M will depend upon the end product, particularly its desired hardness and bond strength, as well as the handling which the ultimate product may encounter. Typical examples of the material M are as follows:

| Microcrystalline Wax | Melting Point | Pen. Values |
|---|---|---|
| Bareco Ultraflex | 143°F. | 30 |
| Be Square | 170°F. | 20 |
| Victory | 165°F. | 30 |

The above listed three microcrystalline waxes are commerically available in both white and brown colors and the penetration values are inversely proportional to the hardness of the wax, namely, the harder the wax the lower the penetration value. If the penetration value is too low (below 10) the hardness of the material at, for example, 40°F., approaches that of the bone B or the product P whereas for higher values within the range of 15–40 proper cushioning is achieved. Penetration values higher than 40 become relatively ineffective as cushions and thus greater amounts of the material M must be deposited upon the bone to afford the level of cushioning protection required.

The types of materials from which the bags 13 are constructed can be single or of multiple ply flexible films that can be heat sealed or mechanically sealed. Commercially available films of this type are known and are approved for use in contact with fresh meat and/or similar edible products. Examples of films from which the bags 13 can be constructed are as follows:

Polyethylene
Polypropylene + Polyethylene
Nylon + Polyethylene
Nylon + Surlyn
Polyvinyl Chloride
Saran The above-listed films may also include an additional coating or layer to act as a barrier to moisture loss from the meat during storage and/or shipment.

An example of a typical package fromed in accordance with this process is the use of a microcystalline wax having a melting point of 175°F. applied directly to the bone and adjacent meat surfaces of a thickness of at least 0.015 inch with the meat or product P and the bone B having a temperature at the time of application between 30°–40°F. The thus coated product is then placed in a bag of a Polypropylene + Polyethylene laminate, evacuated, heat sealed, and placed in a hot air tunnel at a temperature of 350°F. for 9 seconds. With the materials temperatures and times indicated it has been found that the microcrystalline wax adheres to the bag with a bond strength greater than that between the microcrystalline wax and the bone and/or meat, and upon the removal of the bag 13 in the manner illustrated in FIG. 4 the microcrystalline wax M is automatically stripped from the bone B and adjoining surfaces of the meat proper P.

As an alternative method to that of using a conventional hot air tunnel the packaged and sealed bag may be dipped for 5 seconds in water at a temperature of 195°F. which is sufficient to obtain the desired bond strength between the bag and the microcrystalline wax so that it will be removed automatically upon the removal of the bag from the product. In the latter example the microcrystalline wax has a melting point of 175°F.

Though the bag 13 is not purged with an inert gas after evacuation and prior to sealing, purging is considered a step within the preview of this invention. However, a high vacuum is desired in the bag to maintain intimate contact between the interior surface of the bag and the material M to make certain that the two adhere to one another for the automatic removal of the material M from the product P upon the opening of the bag and the removal thereof from the product P in the manner heretofore discussed relative to FIG. 4.

While preferred forms and arrangements of parts have been shown in illustrating the invention, it is to be clearly understood that various changes in detail and arrangement of parts may be made without departing from the spirit and scope of this disclosure.

I claim:

1. A process of packaging an edible product having an exposed bone comprising the steps of applying liquid hot melt material to coat substantially only the exposed bone, encasing the thus coated product in a flexible package, said liquid hot melt material having a penetration value and being applied in an amount and to a location on the bone sufficient to provide cushioning protection for the flexible package from the bone, thereby preventing rupture of the flexible package, and thereafter adhering the hot melt material to the flexible package with a bond strength greater than that between the hot melt material and the bone whereby upon the removal of the edible product from the flexible package the hot melt material peels from the bone and remains adhered to the flexible package.

2. The packaging process as defined in claim 1 including the step of heat shrinking the flexible package after the product has been encased therein.

3. The packaging process as defined in claim 2 wherein the flexible package is a bag of heat shrinkable material, evacuating the bag after encasing the product therein, thereafter hermetically closing the bag, and thereafter performing the heat shrinking step.

4. The packaging process as defined in claim 2 wherein the heat generated during the performance of the heat shrinking step adheres the hot melt material to the flexible package.

5. The packaging process as defined in claim 4 wherein the flexible package is a bag of heat shrinkable material, evacuating the bag after encasing the product therein, thereafter hermetically closing the bag, and thereafter performing the heat shrinking step.

* * * * *